US009675867B2

(12) United States Patent
David

(10) Patent No.: US 9,675,867 B2
(45) Date of Patent: Jun. 13, 2017

(54) SKI BINDING EQUIPMENT

(71) Applicant: X-SPORTS, Toulon (FR)

(72) Inventor: Jean-Marc David, Toulon (FR)

(73) Assignee: X-SPORTS (FR)

( * ) Notice: Subject to any disclaimer, the term of this patent is extended or adjusted under 35 U.S.C. 154(b) by 0 days.

(21) Appl. No.: 14/810,511

(22) Filed: Jul. 28, 2015

(65) Prior Publication Data

US 2017/0028292 A1 Feb. 2, 2017

(51) Int. Cl.

| | |
|---|---|
| ***B63B 35/81*** | (2006.01) |
| ***A63C 5/00*** | (2006.01) |
| ***A63C 9/00*** | (2012.01) |

(52) U.S. Cl.

CPC ..... *A63C 5/003* (2013.01); *A63C 9/005* (2013.01); *B63B 35/81* (2013.01); *B63B 35/812* (2013.01)

(58) Field of Classification Search

CPC ..... A63C 9/08–9/0885; B63B 35/81; B63B 35/812

See application file for complete search history.

(56) References Cited

U.S. PATENT DOCUMENTS

| | | | | |
|---|---|---|---|---|
| 1,559,390 | A | 10/1925 | Waller | |
| 4,624,646 | A | 11/1986 | Strohmeier | |
| 4,738,646 | A | 4/1988 | Ackert et al. | |
| 4,770,648 | A | 9/1988 | Gillis | |
| 4,773,886 | A | 9/1988 | Teeter et al. | |
| 5,785,566 | A | 7/1998 | Blanger | |
| 6,053,522 | A | 4/2000 | Fogarty et al. | |
| 2007/0126190 | A1* | 6/2007 | Fritschi | A43B 5/0413 280/11.26 |
| 2009/0130931 | A1 | 5/2009 | Blanger | |
| 2010/0176576 | A1 | 7/2010 | Lanez et al. | |
| 2014/0342623 | A1 | 11/2014 | Gates | |

FOREIGN PATENT DOCUMENTS

| | | |
|---|---|---|
| FR | 2751238 A1 | 1/1998 |
| GB | 2196905 A | 5/1988 |
| GB | 2197625 A | 5/1988 |

* cited by examiner

*Primary Examiner* — Erez Gurari

(74) *Attorney, Agent, or Firm* — Steven M. Greenberg; CRGO Law

(57) ABSTRACT

The present disclosure relates to a binding equipment for binding a hard-shell boot comprising a profiled bottom surface to a ski, the ski comprising a bottom surface to be directed towards a gliding element and a top surface to be directed towards the boot, wherein the binding equipment is configured to adapt the top surface of the ski to the profiled bottom surface of the boot.

4 Claims, 7 Drawing Sheets

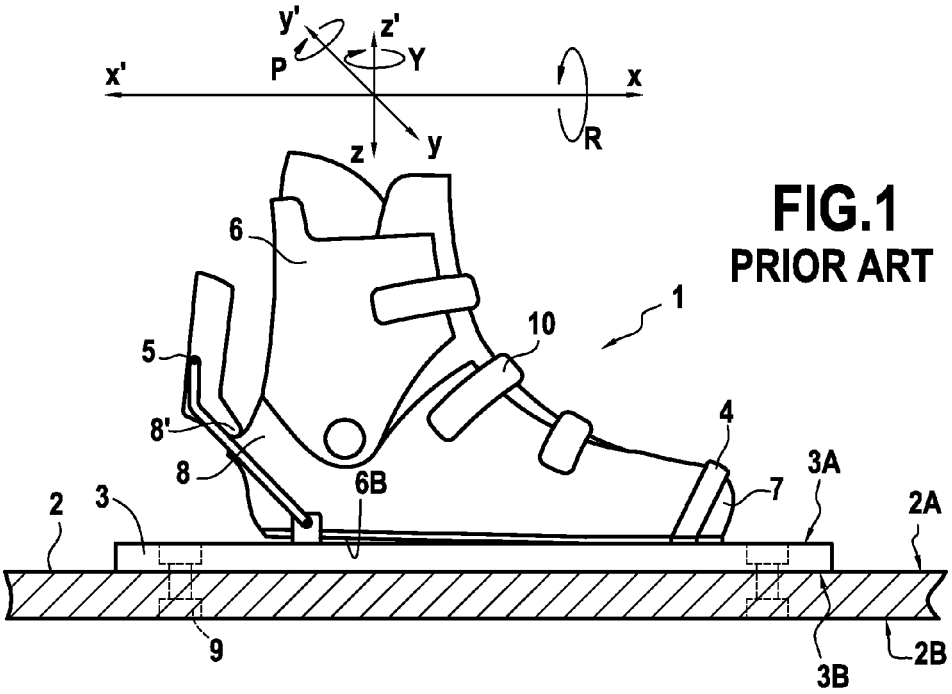
FIG.1
PRIOR ART
FIG.2A
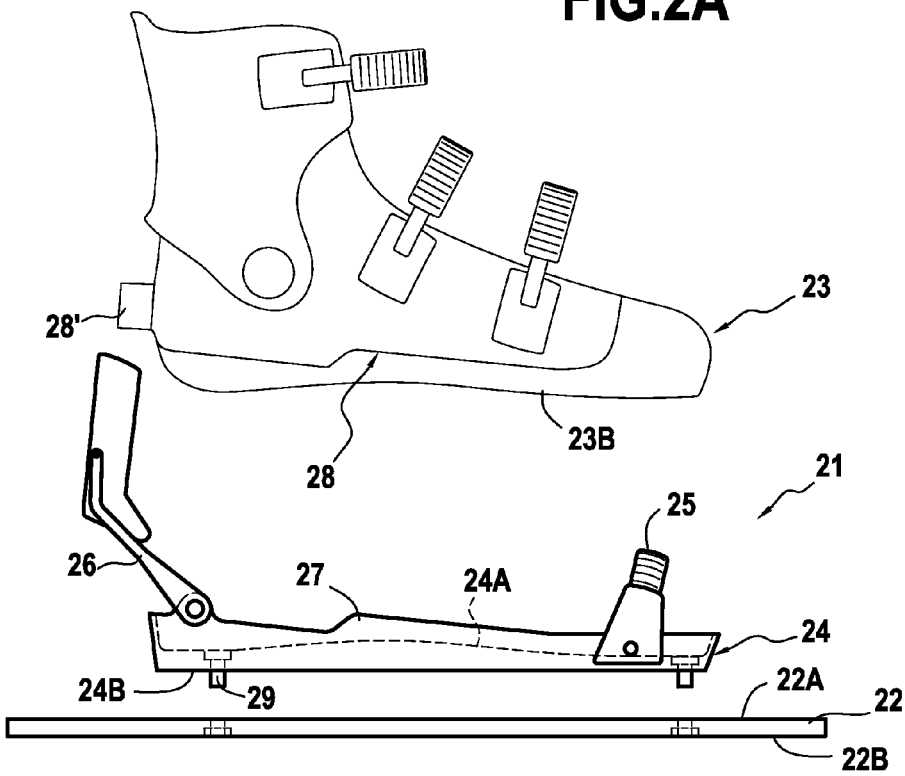

51
53
55
56
58'
54
52
59
57
58

61
63
64
62
69
68
67
69

71
75
74
76
74D
74C
77

81
83
85
86
88'
82
88
87
82A,83B 91
93
92
99
98
97
92A,93B
99

SKI BINDING EQUIPMENT

TECHNICAL FIELD

The present disclosure relates to binding equipment for waterskis and other gliding sports such as wakeboards, snow skis, and snowboards wherein at least one foot of the skier is attached to a board.

BACKGROUND OF THE DISCLOSURE

In general, gliding sports or activities are recreational or competitive sports wherein a skier stands on one or two skis, and is pulled by a boat over the surface of the water or snow. Skis can be used for jumps, flips, speed, slalom turns and the like, with the feet one behind the other pointing in the same direction, next to each other pointing in the same direction, with the heels together and toes pointing in opposite directions, only one foot attached, etc.

Waterskiing was invented almost a hundred years ago, and the first patent, document U.S. Pat. No. 1,559,390, described skis with a simple rubber area for contact with the feet. With time, means for attaching the foot/feet to the ski were developed, such as by rubber cords (webbing or strap), then boots that were either attached to the ski, so that the skier's feet could slide in and out, or else placed on the feet and releasably (or temporarily) attached to the ski. Use of these two types of attachments allows better attachment of the ski to the skier, and thus better control of the ski.

The means for attaching the foot to a ski thus evolved in two different directions, flexible and hard-shell bindings. Flexible bindings generally comprise a boot held by a binding (normally of rubber and tissue) and fixed to the board. These flexible bindings are generally easier to produce and less expensive, but provide less control of the board. Hard-shell bindings comprise boots of hard injected plastic and favor the rigidity of the attachment between the foot and the board. Consequently, there is a risk of injury in case of a fall. To this end, automatic release systems may be provided to free the user's foot in case of a fall, to prevent or at least reduce twisting of joints.

FIG. 1 is a side view of a type of conventional hard-shell waterski binding system 1 comprising: a generally planar ski 2, a base plate 3, a front toe bar 4, a back release 5, and a boot 6, as disclosed by the U.S. Pat. No. 5,785,566 for example.

The ski 2 (or board) comprises a substantially planar top surface 2A directed towards the user and a substantially planar bottom surface 2B directed towards a gliding element (snow, water, sand, etc.). Likewise, the base plate 3 comprises a substantially planar top surface 3A directed towards the user and a substantially planar bottom surface 3B directed towards the ski 2, such that their respective surfaces 3B, 2A are in contact. The base plate 3 receives the front toe bar 4 and the back release 5, and is fixed to the board 2.

The boot 6 comprises a toe 7 and a heel 8 comprising a protrusion 8'. The boot may further comprise an inner liner, buckles to secure the boot around the foot, a hinge to open the boot for insertion of the foot, and so forth, not referenced. The user places the boot 6 on his or her foot, inserts the toe 7 into the front toe bar 4, and then lowers the heel 8 into the back release 5, snapping the boot 6 into place. The boot 6 comprises a bottom surface 6B configured to be placed on the top surface 3A of the base plate 3. Finally, fasteners (e.g., screws) 9 traverse holes in the ski 2 and the base plate 3 to attach the base plate to the ski.

The system 1 is shown with a three-dimensional axis system, wherein an axis X-X' is along the length of the boot, subject to a roll R around the axis, an axis Y-Y' is along the width of the boot subject to a pitch P around the axis, and an axis Z-Z' along the height of the boot subject to a yaw Y around the axis.

The boot and bindings of a second foot are not shown for the sake of simplicity, but they may consist of the same elements, and be either in front of or behind the ensemble shown in the figure (along the X-X' axis), or else next to the ensemble shown (along the Y-Y' axis), or even not present.

Since the waterski industry is relatively small yet requires a large range of sizes and widths to fit the feet of men and women, adults and children, the hard-shell boots sold for waterskiing are generally inline skating boots. Nevertheless, inline skating boots have narrow bottom surfaces 6B to match the form of the foot, creating a good connection between the base of the foot and the skate wheels. Nevertheless, when such boots are repurposed for waterskiing, there is only a small area of contact between the bottom surface 6B of the boot and the top surface 3A of the base plate 3. The back release 5 pushes the boot 6 towards the front toe bar 4 but is unable to prevent roll R around the X-X' axis, inducing a diminished control of the ski 2. Furthermore, "unexpected releases" may occur when the boot slides horizontally out of the binding, due to "play" or "slack" between the front toe bar 4 and the back release 5, which can worsen over time.

SUMMARY OF THE DISCLOSURE

It would therefore be advantageous to provide a binding system able to overcome such an inconvenience.

Embodiments of the disclosure thus relate to a binding equipment for binding a hard-shell boot comprising a profiled bottom surface to a ski, the ski comprising a bottom surface to be directed towards a gliding element and a top surface to be directed towards the boot, wherein the binding equipment is configured to adapt the top surface of the ski to the profiled bottom surface of the boot.

According to one embodiment, the binding equipment comprises a distinct adaptation piece comprising a substantially planar bottom surface configured to be attached to a planar support, the support being a base plate attached to the ski or the ski itself, and a profiled top surface configured to be attached to the bottom surface of the boot, such that the bottom surface of the boot and the top surface of the adaptation piece are complementary.

According to one embodiment, the adaptation piece comprises means for adjusting the angle of the adaptation piece around at least one axis X, Y, Z.

According to one embodiment, the adaptation piece is configured to be permanently attached to the support and further comprises a back release configured to releasably hold the heel of the boot, and a front attachment configured to hold the toe of the boot.

According to one embodiment, the adaptation piece is configured to be permanently attached to the boot, and the support comprises a back release configured to releasably hold the heel of the boot and the adaptation piece, and a front attachment configured to hold the toe of the boot and the adaptation piece.

According to one embodiment, the adaptation piece is configured to be permanently attached to the support, and the support comprises a back release configured to releasably hold the heel of the boot, and a front attachment configured to hold the toe of the boot.

According to one embodiment, the adaptation piece is configured to be permanently fixed to both the boot and the support.

According to one embodiment, the adaptation piece comprises at least a front portion and a back portion that may be separated in order to adjust the length of the adaptation piece.

According to one embodiment, the adaptation piece comprises sidewalls configured to provide lateral support to a boot.

According to one embodiment, the sidewalls of the adaptation piece are configured to match with grooves of the boot.

According to one embodiment, the top surface of the ski itself or of a base plate attached to the ski comprises a profiled zone such that the bottom surface of the boot and the top surface of the zone are complementary.

According to one embodiment, a back release configured to releasably hold the heel of the boot, and a front attachment configured to hold the toe of the boot are attached to the top surface of the ski or the base plate.

According to one embodiment, the ski or the base plate is further configured to be permanently attached to the boot.

According to one embodiment, the zone is further shaped so as to form sidewalls.

Embodiments of the disclosure also relate to a ski comprising a bottom surface to be directed towards a gliding element, a top surface to be directed towards a hard-shell boot comprising a profiled bottom surface, and a binding according to one embodiment of the disclosure, configured to adapt the top surface of the ski to the profiled bottom surface of the boot.

Embodiments of the disclosure also relate to a method of assembling a ski according to the disclosure, the method comprising the steps of providing a ski comprising a bottom surface to be directed towards a gliding element and a top surface to be directed towards a hard-shell boot comprising a profiled bottom surface, and attaching, in a permanent or releasable manner, a binding equipment according to one embodiment of the disclosure.

Embodiments of the disclosure also relate to a method of shaping the top surface of a ski according to the disclosure, the method comprising the steps of providing a ski comprising a bottom surface to be directed towards a gliding element and a top surface to be directed towards a hard-shell boot comprising a profiled bottom surface, and adapting the top surface of the ski itself or of a base plate attached to the ski such that it comprises a profiled zone, so as to be complementary with the bottom surface of a boot.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

BRIEF DESCRIPTION OF THE FIGURES

Other features and advantages of the present disclosure will be described below in relation with the attached figures:

FIG. 1, previously described, is a side view of a conventional hard-shell waterski binding system;

FIGS. 2A, 2B, 2C are respectively a side view, a back view, and a perspective view of a binding system according to a first embodiment of the disclosure in a non-assembled state, the binding system comprising a base plate, a boot, and an adaptation piece;

DETAILED DESCRIPTION

Figure 2B:
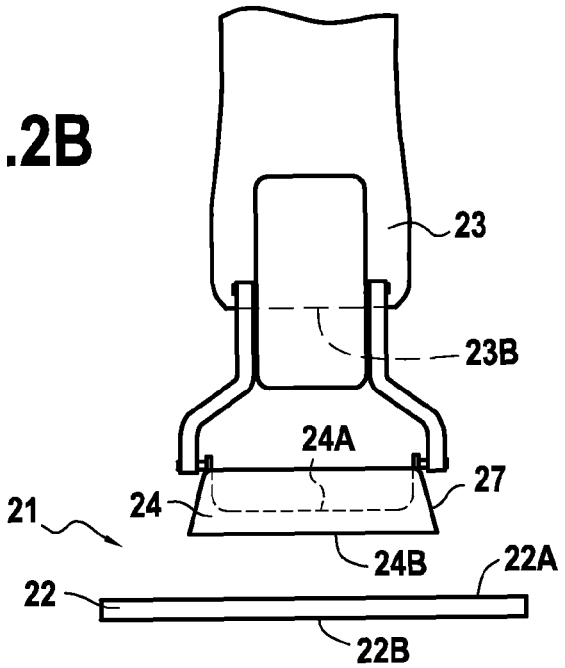
Figure 2C:
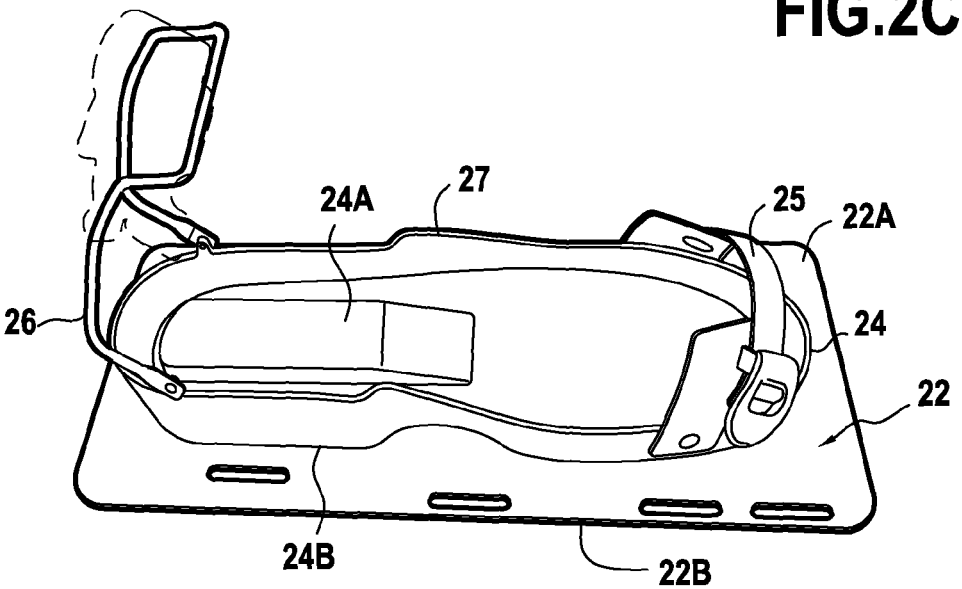

FIGS. 2A, 2B, 2C are respectively a side view, a back view, and a perspective view of a binding system 21 according to a first embodiment of the disclosure in a non-assembled (exploded) state.

The binding system 21 comprises a base plate 22, a hard-shell boot 23, and an adaptation piece 24. The base plate 22 is configured to be attached to a ski, not shown for the sake of simplicity, and comprises a top face 22A and a bottom face 22B that are each essentially planar. By "essentially planar" it is intended to convey that the faces are planar over the majority of the surface, within the limits and tolerances of fabrication systems.

The boot 23 comprises a toe, a heel, buckles, an inner liner, etc. (not referenced) and a profiled bottom face 23B that is non-planar (generally comprising an arch in the middle of the foot and curved edges). By "profiled" it is meant to convey that the boot has a specific form, and not just bumps, grooves, and the like on its bottom surface.

The adaptation piece 24 comprises a top face 24A, a bottom face 24B, a front attachment 25, a back release 26 and a sidewall 27. The top face 24A is profiled to match the profiled bottom face 23B of the boot, and the bottom face 24B is essentially planar and is configured to have a good match with the planar top face 22A of the base plate 22.

Again, by "profiled" it is meant to convey that the top face 24A is specifically formed to match an expected boot.

Here, the front attachment 25 and back release 26 are considered to be "temporary attachment means" since the boot 23 is generally only attached to the base plate 22 and ski for the duration of one trip, and then released, whereas the adaptation piece 24 is assembled with the base plate 22 in a "permanent" manner via a fixing means 29 (fasteners, glue, soldering, or any other fixing means). By the term "permanent", it is meant to convey that the adaptation piece is attached to the base plate and generally left in place.

The sidewalls 27 provide increased lateral support and prevent unexpected releases, the boot 23 sliding laterally out of the front 25 and back 26 attachments. The boot 23 may further comprise grooves or ribs 28 around the lower surface that fit with the contour of the sidewall 27 of the adaptation piece 24, providing extra support and lateral stability when the boot is inserted into the adaptation piece 24. The boot may further comprise a cleat 28' attached to the back of the boot. (It may be noted that inline skating boots generally do not have protrusions 8' as disclosed in relation with FIG. 1, thus the cleats 28' need to be added for connection with a back release.) The back release 26 of the adaptation piece 24 thus comes into contact with the cleat 28'.

Figure 3:
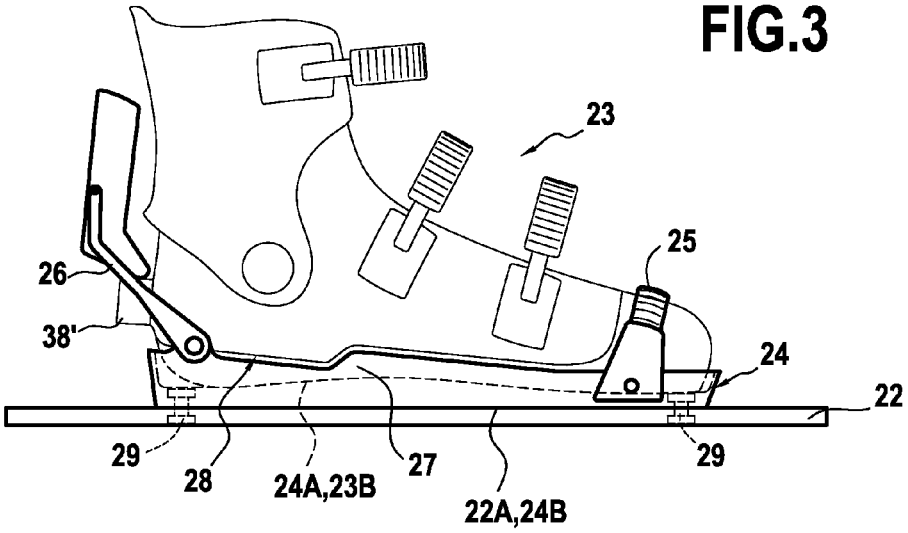
FIG. 3 is a side view of the binding system of FIGS. 2A, 2B, 2C in an assembled state.

FIG. 3 is a side view of the binding system of FIG. 2 in an assembled state. It may be noted that the planar surfaces 22A, 24B (top surface of the base plate 22, bottom surface of the adaptation piece 24) fit together, and that the profiled surfaces 24A, 23B (top surface of the adaptation piece 24, bottom surface of the boot 23) fit together. Furthermore, the ribs 28 of the boot 23 fit with the sidewalls 27 of the adaptation piece 24. The cleat 28' is held by the back release 26, and the toe of the boot is inserted within the front attachment 25.

Figure 4A:
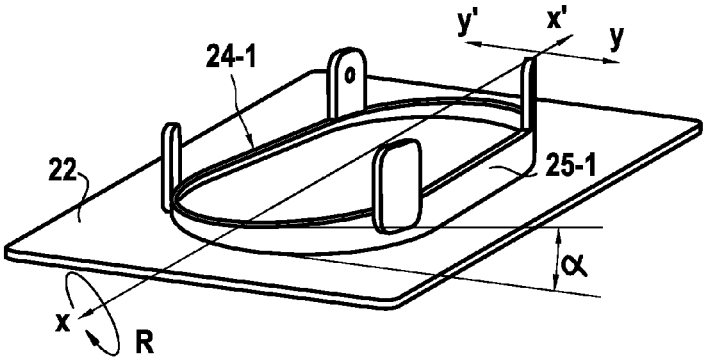
FIGS. 4A, 4B, 4C are perspective views of binding systems according to other embodiments, wherein the adaptation piece may provide different angles of support.
Figure 4B:
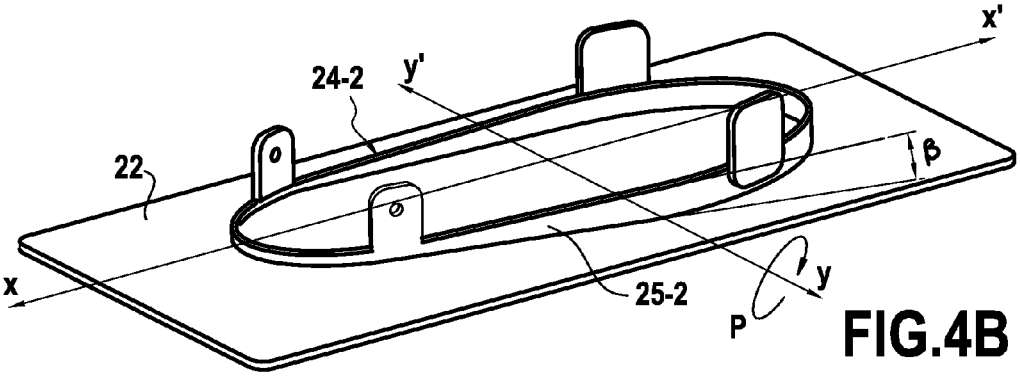
Figure 4C:
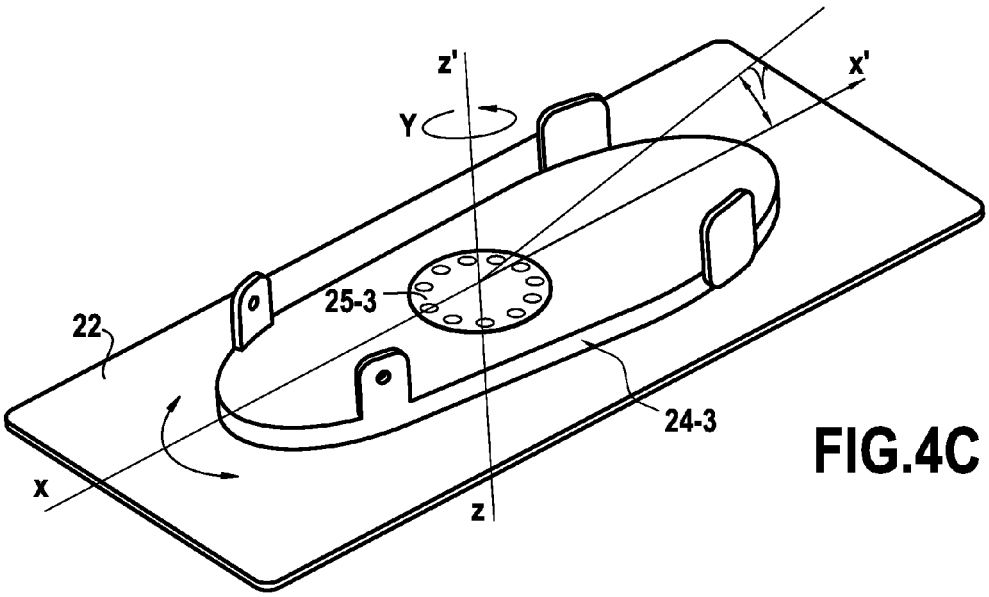

FIGS. 4A, 4B, 4C show perspective views of embodiments of a binding system, in particular bindings that can be adjusted around an axis X, Y, or Z respectively.

FIG. 4A shows an adaptation piece 24-1 comprising a wedge 25-1 disposed between the bottom face 24B of the adaptation piece 24-1 and the top face 22A of the base plate 22. The wedge 25-1 has an angle α (alpha) providing a roll R about the X-X' axis of the user's foot according to his or her preferences. The wedge 25-1 may be a distinct element interposed between the adaptation piece 24-1 and the base plate 22, or may be an integral part of the adaptation piece, either special-ordered by the user, or with standard angles.

FIG. 4B shows an adaptation piece 24-2 comprising a wedge 25-1 disposed between the bottom face 24B of the adaptation piece 24-1 and the top face 22A of the base plate 22. The wedge 25-2 has an angle β (beta) in order to provide a pitch P about the Y-Y' axis of the user's foot according to his or her preferences. Again, the wedge 25-2 may be a distinct element interposed between the adaptation piece 24-2 and the base plate 22, or may be an integral part of the adaptation piece, either special-ordered by the user, or with standard angles.

FIG. 4C shows an adaptation piece 24-3 comprising a means 25-3 for providing an angle γ (gamma) in order to provide a yaw Y about the Z-Z' axis of the user's foot according to his or her preferences. The means 25-3 is for example a disc integrated in the sole of the adaptation piece 24-3, and allows the alignment of the adaptation piece to be adjusted.

It will be understood that the angles around two axes or all three axes X, Y, Z may be adjusted by using a combination of two or of three such methods.

Figure 5:
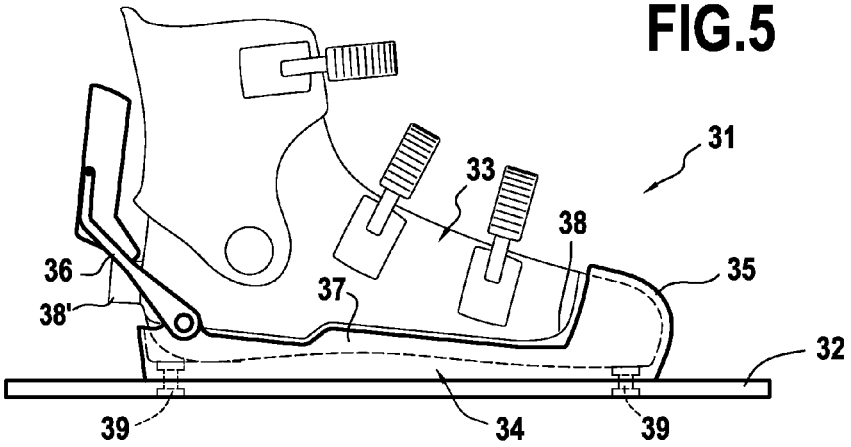
FIG. 5 is a side view of a binding system according to another embodiment, wherein the adaptation piece has a modified front attachment.

FIG. 5 is a side view of a binding system 31 according to another embodiment. The binding system 31 comprises a base plate 32, a hard-shell boot 33, and an adaptation piece 34, similar to the elements described in relation with the FIG. 2 (for the remainder of the description, it has been attempted to follow a similar numbering scheme of the elements).

However, instead of a distinct front attachment, a front section 35 is integrally formed with the adaptation piece 34. Such a configuration may provide a more secure fixation of the front portion of the boot 33. The adaptation piece 34 further comprises a back release 36 and a sidewall 37 that fits with grooves 38 of the boot 33 which comprises a cleat 38'. Fasteners (e.g., screws) 39 permanently fix the adaptation piece 34 to the base plate 32.

Figure 6:
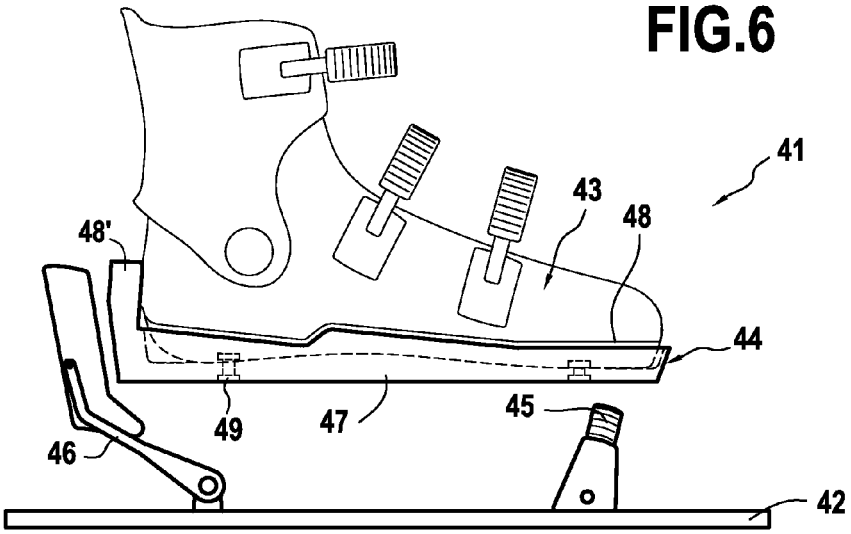
FIG. 6 is a side view of a binding system according to another embodiment, wherein the boot and adaptation piece are permanently fixed together.

FIG. 6 is a side view of a binding system 41 according to another embodiment. The binding system 41 comprises a base plate 42, a hard-shell boot 43, and an adaptation piece 44, similar to the elements described in relation with the FIG. 2. However, instead of the adaptation piece 44 being fixed to the base plate 42, it is permanently fixed to the boot 43 by means of fasteners (e.g., screws) 49.

The base plate 42 comprises a front attachment 45 and a back release 46, configured to temporarily receive the ensemble boot/adaptation piece 43/44. The adaptation piece 44 further comprises sidewalls 47 that fit with grooves 48 of the boot, and a back protrusion 48' that functions as a cleat for securing the ensemble boot/adaptation piece 43/44 by means of the back release 46.

Figure 7:
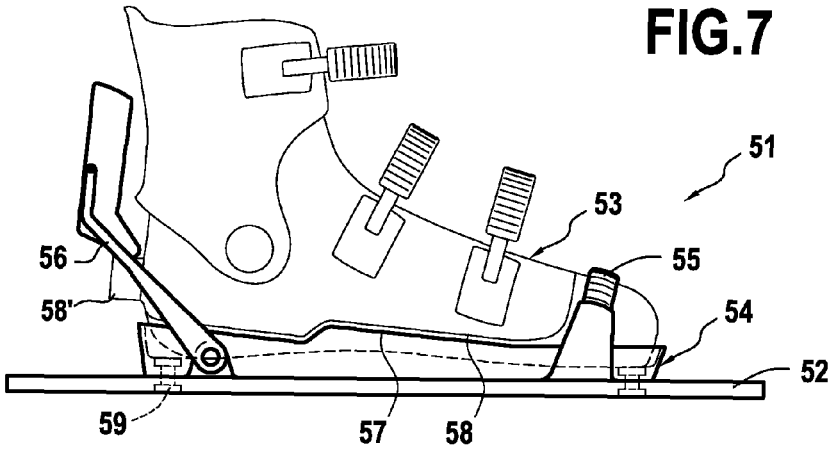
FIG. 7 is a side view of a binding system according to another embodiment, wherein the temporary attachment means are attached to the base plate.

FIG. 7 is a side view of a binding system 51 according to another embodiment. The binding system 51 comprises a base plate 52, a hard-shell boot 53, and an adaptation piece 54, similar to the elements described in relation with the FIG. 2. However, instead of the adaptation piece 54 comprising a front attachment and a back release for releasable attachment of the boot to the ski, a front attachment 55 and a back release 56 are attached to the base plate 52, on the sides of the adaptation piece 54. Such an arrangement may provide increased solidarity of the attachments. The adaptation piece 54 further comprises sidewalls 57 that fit with grooves 58 of the boot, which further comprises a cleat 58'. Fasteners (e.g., screws) 59 permanently fix the adaptation piece 54 to the base plate 54.

Figure 8:
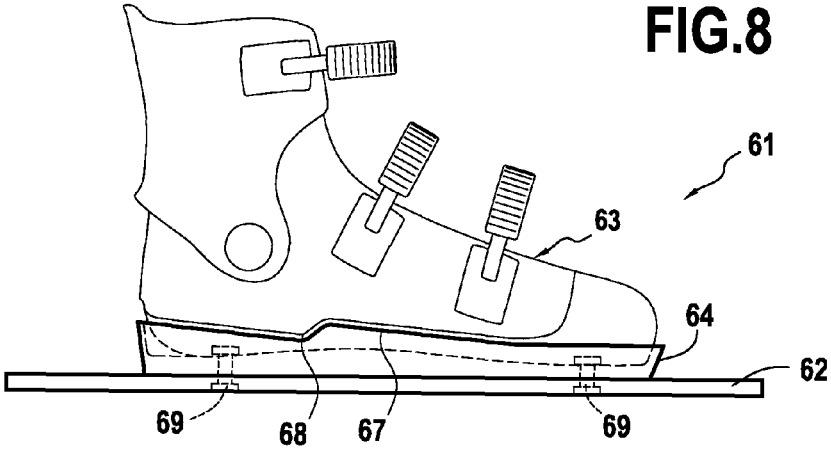
FIG. 8 is a side view of a binding system according to another embodiment, wherein the base plate, boot, and adaptation piece are permanently fixed together.

FIG. 8 is a side view of a binding system 61 according to another embodiment. The binding system 61 comprises a base plate 62, the boot 63 23, and an adaptation piece 64, similar to the elements described in relation with the FIG. 2. However, instead of comprising a front attachment and a back release for releasable attachment of the boot to the ski, the ensemble boot/adaptation piece 63 23/64 are fixed by fixing means, such as fasteners (e.g., screws) 69 to the base plate 62.

It is thus considered that the boot/adaptation piece/base plate are "permanently" fixed together, since during normal use, the boot and/or adaptation piece are not released nor releasable from each other and from the base plate. Thus, the term "permanent", though not strictly-speaking indicating a permanent fixation, is employed here. The bindings thus provide optimal control of the ski, but prevent the skier from being released in the case of a fall, unless the boot 63 itself is equipped with a release mechanism, such as a detachable upper cuff or no cuff, allowing the foot to slide out. It may be noted that the adaptation piece 64 may have sidewalls 67 to fit with grooves 68 of the boot, but a back cleat is not necessary as the boot is permanently fixed.

Figure 9:
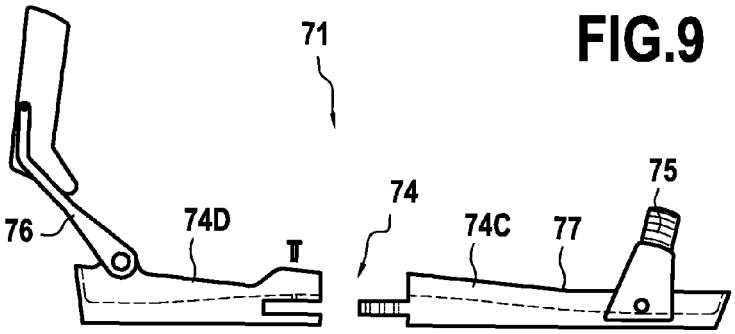
FIG. 9 is a side view of a binding system according to another embodiment, wherein the adaptation piece may be adjusted for different boot sizes.

FIG. 9 is a side view of a binding system 71 according to another embodiment. The system 71 comprises a base plate and a hard-shell boot (not shown) similar to the elements described in relation with the FIG. 2, and an adaptation piece 74 comprising a front section 74C and a back section 74D. The front section 74C comprises a front attachment 75, while the back section 74D comprises a back release 76. The two sections 74C, 74D may be moved closer together or farther away, to adjust for different boot sizes. The adaptation piece 74 comprises sidewalls 77.

Figure 10:
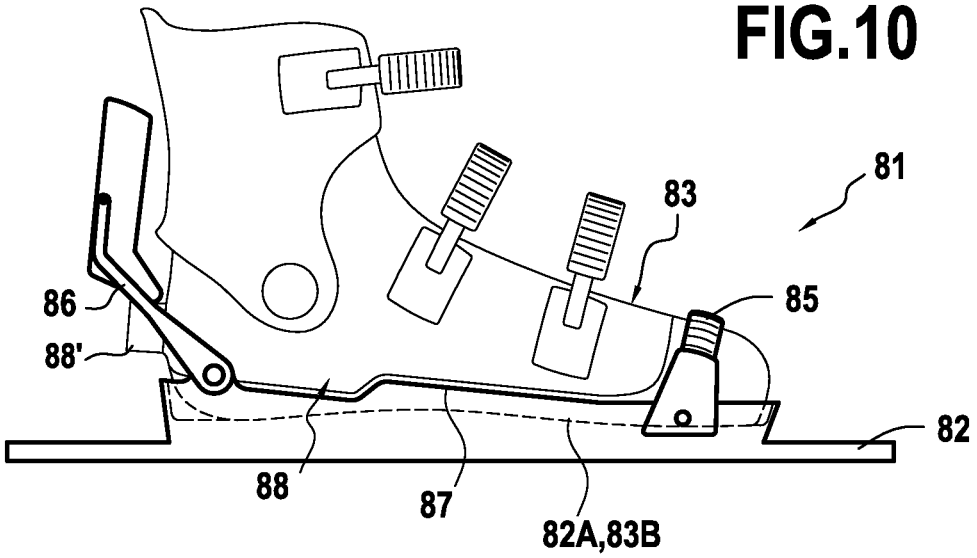
FIG. 10 is a side view of a binding system according to another embodiment, wherein the adaptation means and base plate are integrally formed, the base plate comprising a temporary attachment means of the boot.

FIG. 10 is a side view of a binding system 81 according to another embodiment. The system 81 comprises an adaptation base plate 82 that is integrally formed, such as by molding, so as to present a profiled zone 82A on its upper surface that fits with a profiled bottom surface 83B of a boot 83. The adaptation base plate 82 further comprises a front attachment 85, a back release 86, and sidewalls 87 to fit with grooves 88 of the boot 83, which further comprises a cleat 88'. The adaptation base plate 82 is, in the case, considered to be the "adaptation means" as it adapts the essentially planar top surface of the ski to a profiled bottom surface of the boot.

Figure 11:
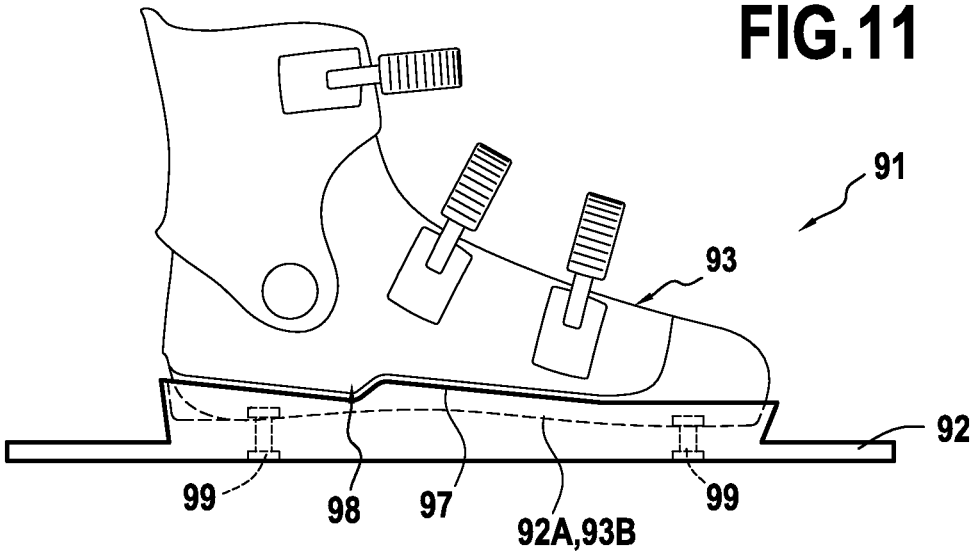
FIG. 11 is a side view of a binding system according to another embodiment, wherein the adaptation means and base plate are integrally formed, the base plate comprising a permanent attachment means of the boot.

FIG. 11 is a side view of a binding system 91 according to another embodiment. The system 91 comprises an adaptation base plate 92 that is integrally formed, such as by molding, so as to present a profiled zone 92A on its upper surface that fits with a profiled bottom surface 93B of a boot 93, similar to that just described. However, instead of comprising a front attachment and a back release for releasable attachment of the boot to the ski, the ensemble adaptation base plate/boot 92/93 are permanently fixed together by means of fasteners (e.g., screws 99). Again, the adaptation base plate 92 may be molded to form sidewalls 97 that fit with grooves 98 of the boot.

The bindings thus provide optimal control of the ski, but prevent the skier from being released in the case of a fall, unless the boot 93 itself is equipped with a release mechanism, such as a detachable upper cuff or no cuff, allowing the foot to slide out.

In the preceding description, the adaptation means has been described with respect to a base plate, but in lieu of a base plate, the adaptation means (either the distinct piece as described in relation with FIGS. 2 to 9, or the molded surface as described in relation with FIGS. 10 and 11) may also be with respect to the ski itself.

Figure 12:
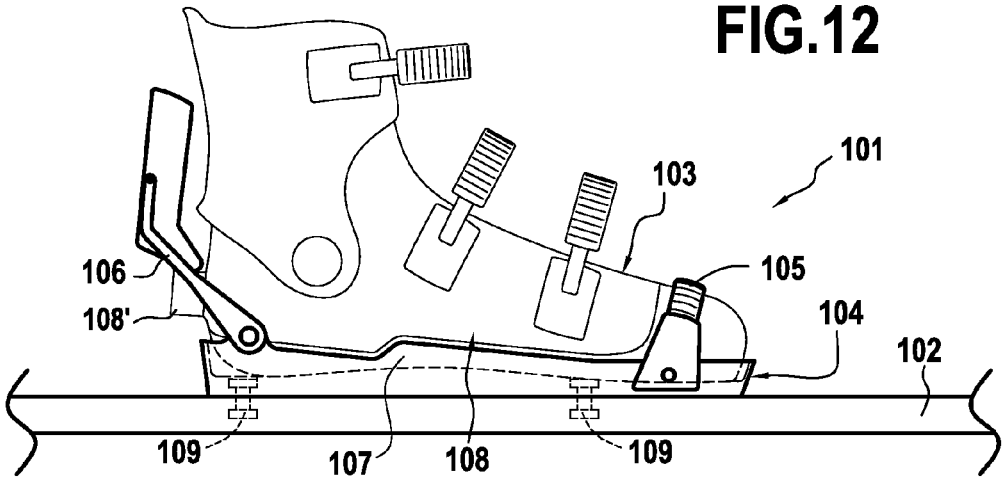
FIG. 12 is a side view of a binding system according to another embodiment, wherein the adaptation piece is permanently fixed directly to the ski and comprises temporary attachment means of the boot.

FIG. 12 is a side view of a binding system 101 according to another embodiment. The binding system 101 comprises a ski 102, a boot 103, and an adaptation piece 104, with no base plate. The adaptation piece 104 comprises a front attachment 105, a back release 106, sidewalls 107 that fit with grooves 108 of the boot, which further comprises a cleat 108'. Fixing means 109 permanently fix the adaptation piece 104 to the ski 102, and may be fasteners (e.g., screws) that completely traverse the ski 102 or "inserts" that are embedded in the body of the ski, as shown here.

Figure 13:
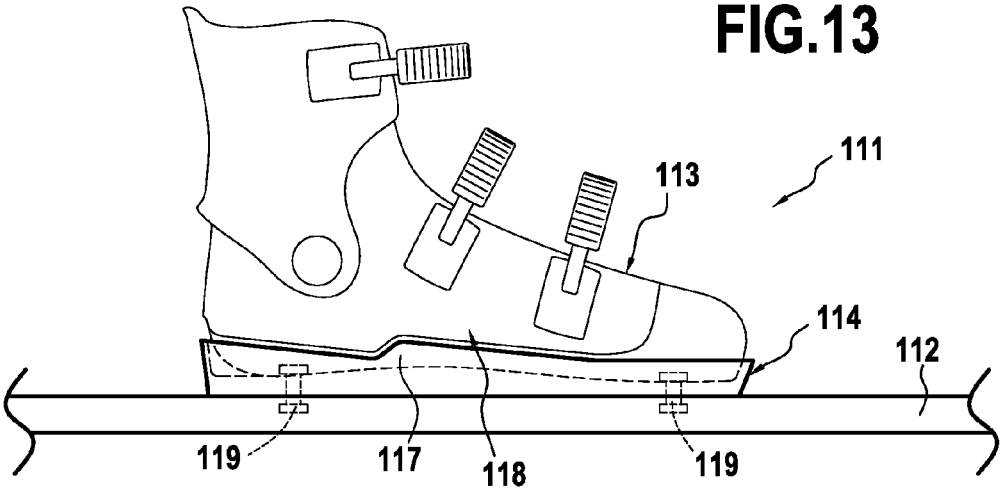
FIG. 13 is a side view of a binding system according to another embodiment, wherein the adaptation piece is permanently fixed directly to the ski and comprises permanent attachment means of the boot.

FIG. 13 is a side view of a binding system 111 according to another embodiment. The binding system 111 comprises a ski 112, a boot 113, and an adaptation piece 114, with no base plate. The adaptation piece 114 comprises sidewalls 117 that fit with grooves 118 of the boot. The system further comprises fixing means 119, such as fasteners (e.g., screws) or inserts as described above, permanently fixing the ski 112, the boot 113 and the adaptation piece 114.

It may be noted that the ski may be formed, such as by molding, so as to present a profiled upper surface, as described in relation with FIGS. 10 and 11.

Furthermore, in the preceding description, the term "waterski" is used merely for the sake of convenience, and should be taken to mean other types of gliding/towing sports on various surfaces, such as snow skiing, snowboarding, wakeboarding, and the like. A ski comprises a bottom surface to be directed towards a gliding element (water, snow, sand, ground, etc.) and a top surface to be directed towards the user, more particularly the user's boot. Furthermore, the bottom surface of the ski is not necessarily planar, and may comprise further elements, such as wheels or a fin.

Finally, different elements of certain embodiments may be combined, such as the adaptation piece in two parts as disclosed in relation with FIG. 9, the front portion as disclosed in relation with FIG. 4, etc.

Thus, the skilled person may modify the apparatus according to the spirit of the disclosure.

Certain aspects of the disclosure are set forth below:

Aspect 1. Binding equipment for binding a hard-shell boot comprising a profiled bottom surface to a ski, the ski comprising a bottom surface to be directed towards a gliding element and a top surface to be directed towards the boot, wherein the binding equipment is configured to adapt the top surface of the ski to the profiled bottom surface of the boot.

Aspect 2. Binding according to aspect 1, wherein the binding equipment comprises a distinct adaptation piece comprising:

- a substantially planar bottom surface configured to be attached to a planar support, the support being a base plate attached to the ski or the ski itself, and
- a profiled top surface configured to be attached to the bottom surface of the boot, such that the bottom surface of the boot and the top surface of the adaptation piece are complementary.

Aspect 3. Binding according to aspect 2, wherein the adaptation piece comprises means for adjusting the angle of the adaptation piece around at least one axis X, Y, Z.

Aspect 4. Binding according to aspect 2, wherein the adaptation piece is configured to be permanently attached to the support and further comprises:

- a back release configured to releasably hold the heel of the boot, and
- a front attachment configured to hold the toe of the boot.

Aspect 5. Binding according to aspect 2, wherein:

- the adaptation piece is configured to be permanently attached to the boot, and
- the support comprises:
  - a back release configured to releasably hold the heel of the boot and the adaptation piece, and
  - a front attachment configured to hold the toe of the boot and the adaptation piece.

Aspect 6. Binding according to aspect 2, wherein:

- the adaptation piece is configured to be permanently attached to the support, and
- the support comprises:
  - a back release configured to releasably hold the heel of the boot, and
  - a front attachment configured to hold the toe of the boot.

Aspect 7. Binding according to aspect 2, wherein the adaptation piece is configured to be permanently fixed to both the boot and the support.

Aspect 8. Binding according to one of aspects 2 to 7, wherein the adaptation piece comprises at least a front portion and a back portion that may be separated in order to adjust the length of the adaptation piece.

Aspect 9. Binding according to one of aspects 2 to 8, wherein the adaptation piece comprises sidewalls configured to provide lateral support to a boot.

Aspect 10. Binding according to aspect 9, wherein the sidewalls of the adaptation piece are configured to match with grooves of the boot.

Aspect 11. Binding according to aspect 1, wherein the top surface of the ski itself or of a base plate attached to the ski comprises a profiled zone such that the bottom surface of the boot and the top surface of the zone are complementary.

Aspect 12. Binding according to aspect 11, wherein a back release configured to releasably hold the heel of the boot, and a front attachment configured to hold the toe of the boot are attached to the top surface of the ski or the base plate.

Aspect 13. Binding according to aspect 11, wherein the ski or the base plate is further configured to be permanently attached to the boot.

Aspect 14. Binding according to one of aspects 11 to 13, wherein the zone is further shaped so as to form sidewalls.

Aspect 15. Ski comprising:

a bottom surface to be directed towards a gliding element, and a top surface to be directed towards a hard-shell boot comprising a profiled bottom surface, and a binding according to one of aspects 1 to 14, configured to adapt the top surface of the ski to the profiled bottom surface of the boot.

Aspect 16. Method of assembling a ski according to aspect 15, comprising the steps of:

providing a ski comprising:

a bottom surface to be directed towards a gliding element, and a top surface to be directed towards a hard-shell boot comprising a profiled bottom surface, attaching, in a permanent or releasable manner, a binding equipment according to one of aspects 1 to 10.

Aspect 17. Method of shaping the top surface of a ski according to aspect 15, comprising the steps of:

providing a ski comprising:

a bottom surface to be directed towards a gliding element, and a top surface to be directed towards a hard-shell boot comprising a profiled bottom surface, and adapting the top surface of the ski itself or of a base plate attached to the ski such that it comprises a profiled zone, so as to be complementary with the bottom surface of a boot.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A binding system for binding a hard-shell boot to a water ski, the system comprising:

an adaptation piece comprising a substantially flat bottom surface configured to substantially continuously contact a top surface of a base plate, a bottom surface of the base plate continuously contacting a top surface of the water ski, a top surface of the adaptation piece that is opposite the bottom surface of the adaptation piece continuously contacting a bottom surface of a boot, the top surface of the adaptation piece also including a convex portion extending outwardly from the top surface of the adaptation piece and substantially continuously contacting a corresponding concave profiled portion of the bottom surface of the boot; and, a binding configured to secure the boot to the water ski by contacting both a top surface of a toe of the boot and pulling the toe towards the adaptation piece, and also a top surface of a heel of the boot and pulling the heel towards the adaptation piece.

2. The binding system according to claim 1, substantially flat bottom surface of the adaptation piece being attached to a planar support comprising a base plate attached to the top surface of the water ski.

3. The binding according to claim 2, wherein the adaptation piece comprises sidewalls configured to provide lateral support to the boot.

4. The binding according to claim 3, wherein the sidewalls of the adaptation piece are configured to match with grooves of the boot.

* * * * *